US011280516B2

(12) United States Patent
Lee et al.

(10) Patent No.: US 11,280,516 B2
(45) Date of Patent: Mar. 22, 2022

(54) CEILING TYPE AIR CONDITIONER AND CONTROLLING METHOD THEREOF

(71) Applicant: LG ELECTRONICS INC., Seoul (KR)

(72) Inventors: Juyoun Lee, Seoul (KR); Jusu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 257 days.

(21) Appl. No.: 16/427,434

(22) Filed: May 31, 2019

(65) Prior Publication Data

US 2019/0368773 A1 Dec. 5, 2019

(30) Foreign Application Priority Data

Jun. 1, 2018 (KR) ..... 10-2018-0063543

(51) Int. Cl.
*F24F 13/10* (2006.01)
*F24F 11/79* (2018.01)
*F24F 1/0047* (2019.01)

(52) U.S. Cl.
CPC ..... *F24F 13/10* (2013.01); *F24F 1/0047* (2019.02); *F24F 11/79* (2018.01)

(58) Field of Classification Search
CPC ..... F24F 13/10; F24F 13/072; F24F 13/1413; F24F 11/79; F24F 11/755; F24F 11/30;
(Continued)

(56) References Cited

U.S. PATENT DOCUMENTS

2012/0174608 A1* 7/2012 Kumamoto ..... F24F 1/0014 62/186
2012/0220212 A1* 8/2012 Tsuji ..... F24F 11/30 454/333

(Continued)

FOREIGN PATENT DOCUMENTS

EP 3 096 088 11/2016
JP 2015-068603 4/2015

(Continued)

OTHER PUBLICATIONS

European Search Report dated Sep. 30, 2019 issued in EP Application No. 19177603.8.
Korean Office Action dated Jan. 17, 2020.

*Primary Examiner* — Steven B McAllister
*Assistant Examiner* — Charles R Brawner
(74) *Attorney, Agent, or Firm* — KED & Associates LLP

(57) ABSTRACT

A method of controlling a ceiling type air conditioner including a panel located on a ceiling surface, outlets formed to correspond to four sides of the panel, and first to fourth discharge vanes for opening and closing the outlets, and each of the first to fourth discharge vanes including an upper discharge vane and a lower discharge vane located below the upper discharge vane and rotating along with the upper discharge vane includes performing first operation, performing second operation, performing third operation, and performing fourth operation in which the first discharge vane rotates in the second angle group, the second discharge vane rotates in the third angle group, the third discharge vane rotates in the fourth angle group and the fourth discharge vane rotates in the first angle group. The first to the fourth angle groups are set such that rotation angles of the discharge vanes have different ranges.

15 Claims, 9 Drawing Sheets
(4 of 9 Drawing Sheet(s) Filed in Color)

(58) Field of Classification Search
CPC ..... F24F 1/0047; F24F 1/0014; F24F 1/0011; F24F 2007/005; F24F 2221/14; F24F 1/64
USPC ..... 454/270
See application file for complete search history.

(56) References Cited

U.S. PATENT DOCUMENTS

| | | | | |
|---|---|---|---|---|
| 2012/0225618 | A1* | 9/2012 | Nouchi | F24F 1/0011 454/258 |
| 2012/0288363 | A1* | 11/2012 | Yumoto | F24F 1/0047 415/182.1 |
| 2015/0087219 | A1* | 3/2015 | Yasutomi | F24F 1/0057 454/256 |
| 2015/0153063 | A1* | 6/2015 | Yasutomi | F24F 1/0057 454/241 |
| 2015/0211756 | A1* | 7/2015 | Jeong | F24F 1/0047 454/248 |
| 2016/0341438 | A1 | 11/2016 | Yaegashi et al. | |
| 2018/0038613 | A1* | 2/2018 | Tomohito | F24F 13/1413 |
| 2018/0299164 | A1* | 10/2018 | Suhara | F24F 11/61 |
| 2019/0219277 | A1* | 7/2019 | Kim | F24F 13/10 |

FOREIGN PATENT DOCUMENTS

| | | |
|---|---|---|
| JP | 2016-217618 | 12/2016 |
| JP | 2017-215086 | 12/2017 |
| KR | 10-2006-0002528 | 1/2006 |
| KR | 10-2016-0101848 | 8/2016 |
| WO | WO 2011/099608 | 8/2011 |

* cited by examiner

AIRFLOW FREQUENCY CHARACTERISTIC GRAPH OF NATURAL WIND

AIRFLOW FREQUENCY CHARACTERISTIC GRAPH OF NATRUAL WIND MODE (WHIRLWIND) ACCORDING TO EMBODIMENT OF INVENTION

FIG. 7

| COOLING OPERATION | | GENERAL AUTO SWING MODE | NATRUAL WIND MODE (WHIRLWIND) |
|---|---|---|---|
| VERTICAL TEMPERATURE DISTRIBUTION | 32℃ | | |
| HORIZONTAL (1.1m) TEMPERATURE DISTRIBUTION | 23℃ | | |
| HORIZONTAL (0.1m) TEMPERATURE DISTRIBUTION | | | |
| TIME REQUIRED FOR DECREASING BY 1℃ (sec) | | 0:10:45 | 0:11:00 |
| TIME REQUIRED TO REACH SET TEMPERATURE (sec) | | 0:22:40 | 0:20:51 |

(EXPERIMENTAL CONDITION: OUTDOOR TEMPERATURE IS 35±0.5℃, INDOOR TEMPERATURE IS 30±0.3℃, SET TEMPERATURE IS 26℃ AND FAN ROTATION SPEED IS 500 RPM)

FIG. 8

| HEATING OPERATION | | GENERAL AUTO SWING MODE | NATRUAL WIND MODE (WHIRLWIND) |
|---|---|---|---|
| VERTICAL TEMPERATURE DISTRIBUTION | 28℃ | 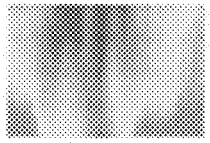 | 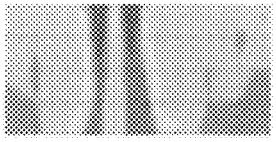 |
| HORIZONTAL (1.1m) TEMPERATURE DISTRIBUTION | 16℃ | 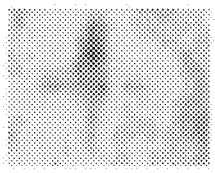 | 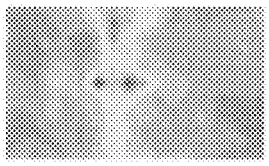 |
| HORIZONTAL (0.1m) TEMPERATURE DISTRIBUTION | | 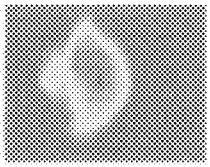 | 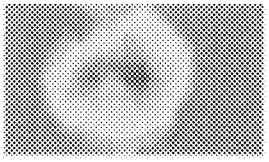 |
| TIME REQUIRED FOR DECREASING 8° 1℃ [sec] | | 0:06:46 | 0:06:50 |
| TIME REQUIRED TO REACH SET TEMPERATURE [sec] | | 0:28:08 | 0:29:40 |
| TEMPERATURE DIFFERENCE (0.1m VERTICAL DIRECTION (1.1 TO 0.1m) | | 2.3 | 1.0 |

[EXPERIMENTAL CONDITION: OUTDOOR TEMPERATURE IS 7±0.3℃, INDOOR TEMPERATURE IS 12±0.3℃, SET TEMPERATURE IS 23℃ AND FAN ROTATION SPEED IS 670 RPM]

CEILING TYPE AIR CONDITIONER AND CONTROLLING METHOD THEREOF

CROSS-REFERENCE TO RELATED APPLICATIONS

The present application claims priority under 35 U.S.C. 119 and 35 U.S.C. 365 to Korean Patent Application No. 10-2018-0063543 (filed on Jun. 1, 2018) which is hereby incorporated by reference in its entirety.

BACKGROUND

The present invention relates to a ceiling type air conditioner and a method of controlling the same.

An air conditioner is an apparatus for maintaining air of a predetermined space in a best state according to usage or purposes thereof. In general, the air conditioner includes a compressor, a condenser, an expansion device and an evaporator. A freezing cycle for performing compression, condensation, expansion and evaporation of refrigerant may be performed to cool or heat the predetermined space.

The predetermined space may be changed according to place where the air conditioner is used. For example, when the air conditioner is positioned in home or office, the predetermined space may be an indoor space of a house or building.

When the air conditioner performs cooling operation, an outdoor heat exchanger provided in an outdoor unit performs a condensation function and an indoor heat exchanger provided in an indoor unit performs an evaporation function. In contrast, when the air conditioner performs heating operation, the outdoor heat exchanger performs a condensation function and the indoor heat exchanger performs an evaporation function.

The air conditioner may be classified into an upright type, a wall-mounted type or a ceiling type according to the installation position thereof. The upright type air conditioner refers to an air conditioner standing up in an indoor space, and the wall-mounted type air conditioner refers to an air conditioner attached to a wall surface.

In addition, the ceiling type air conditioner is understood as an air conditioner installed in a ceiling. For example, the ceiling type air conditioner includes a casing embedded in a ceiling and a panel coupled to a lower side of the casing and including an inlet and an outlet formed therein.

Information on the related art is as follows.

1. Patent Publication No. (Publication Date): 10-2006-0002528 (Jan. 9, 2006)

2. Title of the Invention: Method of controlling discharge airflow of indoor unit of air conditioner In the related art, discharge airflow of an indoor unit is made similar to natural wind by controlling a speed for rotating upper and lower vanes between a maximum upward angle and a maximum downward angle to a high speed or a low speed according to a set cycle.

However, in the air conditioner of the related art, since a time when a rotation angular speed of a vane is reduced and a time when the vane is stopped are periodically applied in order to implement the characteristics of natural wind, a time required to reach an indoor air conditioning environment desired by a user is excessively increased.

In particular, the control method disclosed in the related art has a disadvantage in that a time required to decrease or increase an indoor temperature according to cooling/heating operation in a natural wind mode is remarkably increased as compared to a general auto swing mode. As a result, a time required to implement an air conditioning environment in which a user may feel a pleasant feeling is remarkably increased.

In addition, according to the related art, provided airflow significantly varies depending on where a user is present in a room in which an air conditioner is installed. In addition, it is difficult to provide a pleasant feeling desired by a user.

SUMMARY

Embodiments provide a method of controlling a ceiling type air conditioner capable of improving a pleasant feeling of a user by providing discharge airflow similar to natural wind.

Embodiments provide a method of controlling a ceiling type air conditioner capable of enabling an indoor air conditioning environment to rapidly reach an environment set by a user.

Embodiments provide a method of controlling ceiling type air conditioner capable of relatively uniformly providing a temperature distribution or airflow distribution of an indoor space in which an air conditioner is installed.

In one embodiment, a ceiling type air conditioner includes a panel located on a ceiling surface, outlets formed to correspond to four sides of the panel, and first to fourth discharge vanes for opening and closing the outlets.

In addition, each of the first to fourth discharge vanes including an upper discharge vane and a lower discharge vane located below the upper discharge vane and rotating along with the upper discharge vane.

The method of controlling the ceiling type air conditioner according to the embodiment of the present invention includes performing first operation in which the first discharge vane rotates in a first angle group, the second discharge vane rotates in a second angle group, the third discharge vane rotates in a third angle group and the fourth discharge vane rotates in a fourth angle group, performing second operation in which the first discharge vane rotates in the fourth angle group, the second discharge vane rotates in the first angle group, the third discharge vane rotates in the second angle group and the fourth discharge vane rotates in the third angle group, performing third operation in which the first discharge vane rotates in the third angle group, the second discharge vane rotates in the fourth angle group, the third discharge vane rotates in the first angle group and the fourth discharge vane rotates in the second angle group, and performing fourth operation in which the first discharge vane rotates in the second angle group, the second discharge vane rotates in the third angle group, the third discharge vane rotates in the fourth angle group and the fourth discharge vane rotates in the first angle group.

Here, the first to the fourth angle groups may be set such that rotation angles of the discharge vanes have different ranges.

In addition, the first to fourth discharge vanes may guide discharged air to relatively closest to the ceiling surface when rotating in the first angle group, and guide discharged air to relatively closest to an indoor floor surface when rotating in the fourth angle group.

The first to fourth operations may be performed for a set time.

In addition, the first angle group may include a smallest rotation angle of the upper discharge vane and a smallest rotation angle of the lower discharge vane.

In addition, the fourth angle group may include a largest rotation angle of the upper discharge vane and a largest rotation angle of the lower discharge vane.

A range of a rotation angle of the upper discharge vane may be less than a range of a rotation angle of the lower discharge vane.

In addition, in the first angle group, a rotation angle of the upper discharge vane may be set to 58° or more and less than 71°, and a rotation angle of the lower discharge vane may be set to 15° or more and less than 45°.

In addition, in the second angle group, a rotation angle of the upper discharge vane may be set to 64° or more and less than 72°, and a rotation angle of the lower discharge vane may be set to 25° or more and less than 55°.

In addition, in the third angle group, a rotation angle of the upper discharge vane may be set to 68° or more and less than 73°, and a rotation angle of the lower discharge vane may be set to 35° or more and less than 64°.

In addition, in the fourth angle group, a rotation angle of the upper discharge vane may be set to 71° or more and less than 74°, and a rotation angle of the lower discharge vane may be set to 45° or more and less than 72°.

In another aspect, a ceiling type air conditioner includes a panel located on a ceiling surface, outlets formed to correspond to four sides of the panel, discharge vanes provided on the four outlets and each including an upper discharge vane and a lower discharge vane located below the upper discharge vane and rotating along with the upper discharge vane, and a controller configured to control rotation angles of the discharge vanes.

The controller may control a first discharge vane located at any one of the four outlets to follow a first angle group including a smallest rotation angle.

In addition, the controller may control a second discharge vane located at a position rotated from the first discharge vane clockwise to follow a second angle group having a rotation angle greater than that of the first angle group.

In addition, the controller may control a third discharge vane located at a position rotated from the second discharge vane clockwise to follow a third angle group having a rotation angle greater than that of the second angle group.

In addition, the controller may control a fourth discharge vane located at a position rotated from the third discharge vane clockwise to follow a fourth angle group having a rotation angle greater than that of the third angle group.

In addition, the controller may control the second to third discharge vanes to sequentially follow the first angle group when a predetermined time has elapsed.

In addition, the controller may control the first discharge vane to sequentially rotate in the second to fourth angle groups as a predetermined has elapsed.

In addition, the controller may count the number of cycles in which the first discharge vane rotates in the first to fourth angle groups.

In addition, the controller may repeatedly control the first discharge vane to rotate in the first angle group when the counted number of cycles is less than a predetermined number of cycles.

The present invention has the following effects.

First, it is possible to improve product reliability, by rapidly forming airflow relatively similar to natural wind in an indoor space.

Second, since a user is brought into contact with airflow similar to natural wind formed by four-way air discharged from ceiling in various directions, it is possible to improve a pleasant feeling of the user.

Third, it is possible to shorten a time required to reach an indoor air conditioning environment set by a user even in a natural wind mode, by implementing a whirlwind in an indoor space.

Fourth, a difference between a time required to reach a set temperature in a natural wind mode and a time required to reach a set temperature in an auto swing mode in general cooling/heating operation is small. Therefore, it is possible to more rapidly improve the pleasant feeling of the user.

Fifth, air discharged by upper discharge vanes and lower discharge vanes located at different angles forms swirling airflow in a boundary between the lower portion and the wall of the indoor space. Therefore, indoor air is rapidly mixed to rapidly reach an air conditioning environment set by the user.

Sixth, since air discharged from the ceiling is simultaneously provided at different angles with elapse of time, it is possible to relatively uniformly provide the temperature distribution or airflow distribution of the indoor space. In particular, it is possible to minimize a vertical temperature difference in heating operation as compared to a general auto swing mode.

Seventh, since an area of air guided by the discharge vane is increased, it is possible to guide discharge airflow to a relatively long distance.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 7 is a table showing a result of comparison between a natural mode (whirlwind) in cooling operation of a ceiling type air conditioner according to an embodiment of the present invention and a general auto swing mode.

FIG. 8 is a table showing a result of comparison between a natural mode (whirlwind) in heating operation of a ceiling type air conditioner according to an embodiment of the present invention and a general auto swing mode.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s).

Figure 1:
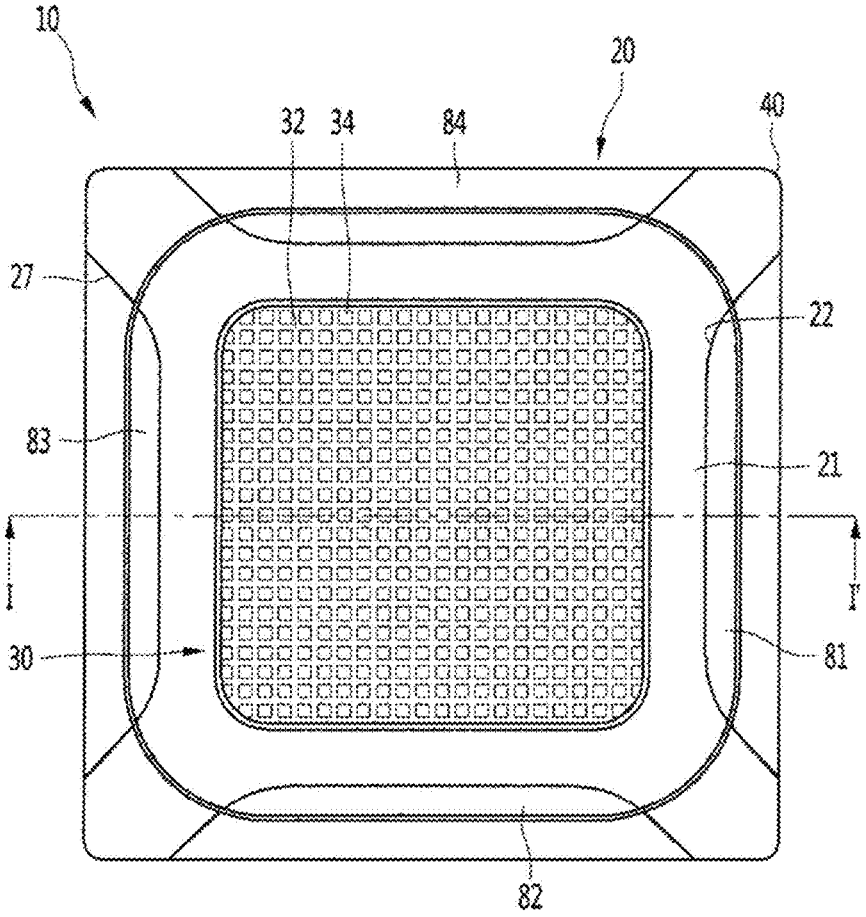
FIG. 1 is bottom view showing the configuration of a ceiling type air conditioner according to an embodiment of the present invention.
Figure 2:
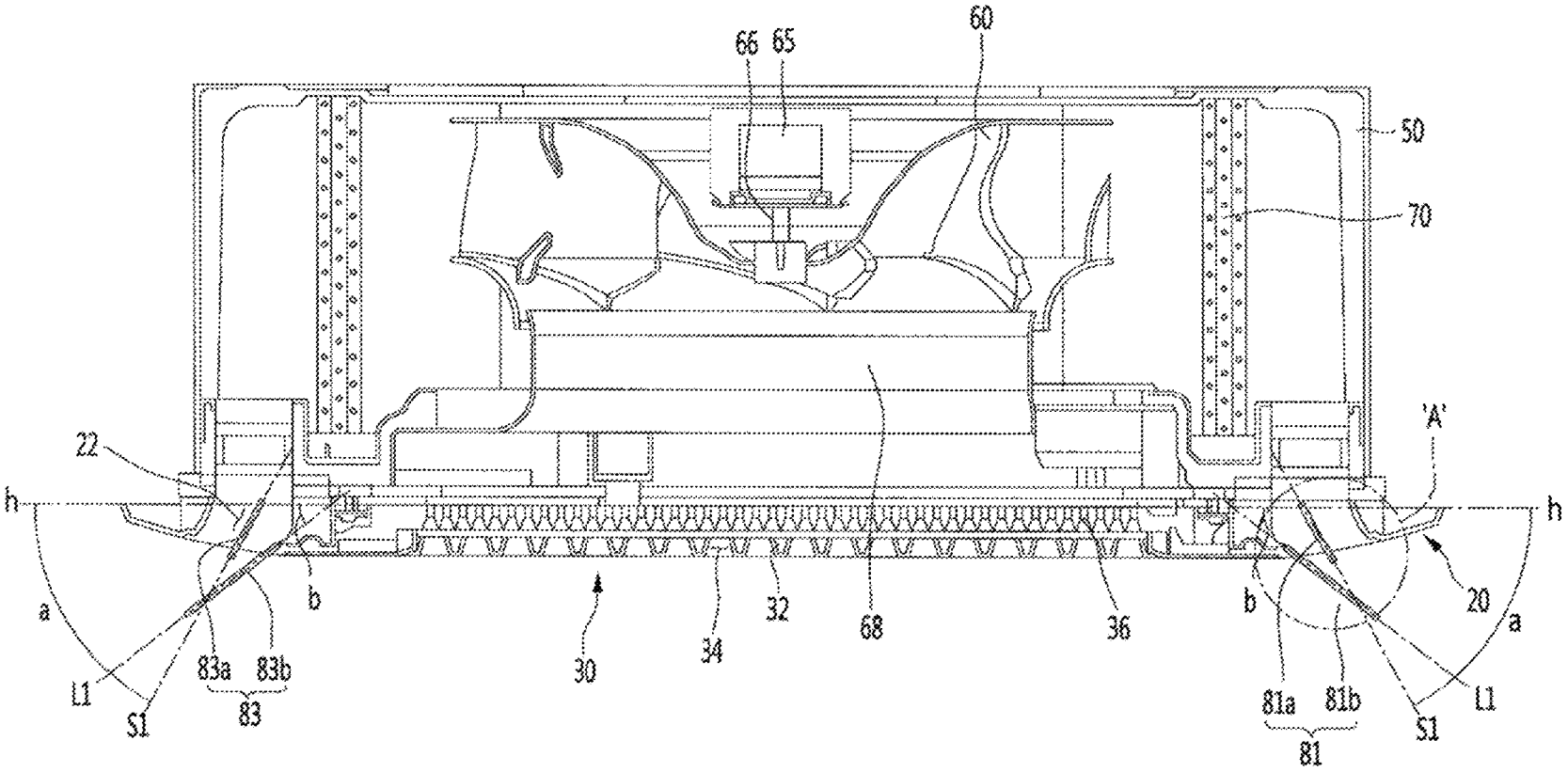
FIG. 2 is a cross-sectional view taken along line I-I' of FIG. 1.

FIG. 1 is bottom view showing the configuration of a ceiling type air conditioner according to an embodiment of the present invention, and FIG. 2 is a cross-sectional view taken along line I-I' of FIG. 1.

Referring to FIGS. 1 to 2, the ceiling type air conditioner 10 (hereinafter referred to as an air conditioner) according to the embodiment of the present invention includes a casing 50 and a panel 20.

The casing 50 is embedded in the internal space of a ceiling and the panel 20 is substantially located at a height of the ceiling to be exposed to the outside. A plurality of parts may be installed in the casing 50.

The plurality of parts includes a heat exchanger 70 for exchanging heat with air sucked into the casing 50. The heat exchanger 70 may be disposed to be bent multiple times along the inner surface of the casing 50 and to surround a fan 60.

The plurality of parts further includes a fan 60 driven for suction and discharge of indoor air and an air guide 68 for guiding air sucked toward the fan 60. The fan 60 is coupled with a motor shaft 66 of a fan motor 65. The fan 60 may rotate by driving the fan motor 65. The air guide 68 is disposed at the suction side of the fan 60 to guide air sucked through an inlet 34 toward the fan 60. For example, the fan 60 may include a centrifugal fan.

The panel 20 is mounted on the lower end of the casing 50 and may be substantially formed in a rectangular shape when viewed from the lower side thereof. In addition, the panel 20 may be formed to protrude outward from the lower end of the casing 50 and a circumference thereof may be in contact with a lower surface (ceiling surface) of the ceiling.

The panel 20 includes a panel body 21 and outlets 22, through which air of the internal space of the casing 50 is discharged.

The outlets 22 may be formed by perforating at least a portion of the panel body 21 and may be formed at positions corresponding to four sides of the panel body 21.

That is, the outlets 22 may be formed along the extension directions of the four sides of the panel 20. Here, the extension direction may be understood as the longitudinal direction of one of the four sides of the panel 20. In addition, the direction perpendicular to the longitudinal direction may be understood as a width direction.

The air conditioner 10 further includes discharge vanes 81, 82, 83 and 84 for opening and closing the outlets 22 and a discharge motor 90 for rotating the discharge vanes.

The discharge vanes 81, 82, 83 and 84 may be mounted in the panel 20. In addition, the discharge vanes 81, 82, 83 and 84 may be formed in a shape corresponding to the opening shape of the outlet 22. Accordingly, the discharge vanes 81, 82, 83 and 84 may open or close the outlets 22 formed at the four sides of the panel 20.

In addition, the discharge vanes 81, 82, 83 and 84 are provided with two dual guide portions 81*a*, 83*a*, 81*b* and 83*b* for guiding the discharge direction of air passing through the internal space of the casing 50.

The dual guide portions are disposed to be spaced apart from each other in the upward-and-downward direction or in the inward-and-outward direction. The discharge vanes 81, 82, 83 and 84 may guide air discharged into the indoor space, in which the air conditioner 10 is installed, in directions according to two angles.

Accordingly, since a guide area and length of discharged air are relatively increased, the discharged air can reach up to a longer distance. In particular, it is possible to rapidly increase the temperature of the lower portion of the indoor space corresponding to the user activity area in an environment in which heating is performed.

The upper guide portions of the dual guide portions are defined as upper discharge vanes 81*a* and 83*a* and the lower guide portions thereof are defined as lower discharge vanes 81*b* and 83*b*.

That is, the discharge vanes 81, 82, 83 and 84 include the upper discharge vanes 81*a* and 83*a* and the lower discharge vanes 81*b* and 83*b* for guiding the discharged air at set angles.

The upper discharge vanes 81*a* and 83*a* are disposed at the upstream side or inside of the lower discharge vanes 81*b* and 83*b*. Accordingly, the upper discharge vanes 81*a* and 83*a* may also be referred to as internal vanes.

In addition, the lower discharge vanes 81*b* and 83*b* may be downstream side or outside of the upper discharge vanes 81*a* and 83*a*. Accordingly, the lower discharge vanes 81*b* and 83*b* may also be referred to as external vanes.

The upper discharge vanes 81*a* and 83*a* and the lower discharge vanes 81*b* and 83*b* may guide the discharged air at different angles. That is, the direction of the discharged air guided by the upper discharge vanes 81*a* and 83*a* and the direction of the discharge air guided by the lower discharge vanes 81*b* and 83*b* may be different.

For example, air discharged from the upper discharge vanes 81*a* and 83*a* may be discharged to the upper side of the indoor space than air discharged from the lower discharge vanes 81*b* and 83*b*.

In addition, the lower discharge vanes 81*b* and 83*b* may be formed to have a larger area of an air guide surface than the upper discharge vanes 81*a* and 83*a*. That is, the lower discharge vanes 81*b* and 83*b* may extend to have a greater width than the upper discharge vanes 81*a* and 83*a*.

In other words, the lower discharge vanes 81*b* and 83*b* may be formed to have a larger length than the upper discharge vanes 81*a* and 83*a* in the discharge direction of air.

Accordingly, air discharged from the lower discharge vanes 81*b* and 83*b* may reach a farther position than air discharged from the upper discharge vanes 81*a* and 83*a*. Accordingly, in particular, in the heating operation, the discharged air guided by the lower discharge vanes 81*b* and 83*b* flows in a relatively long distance, thereby providing warm air to the floor surface.

In addition, since it is possible to provide warm air to the floor surface, in which cold air is mainly distributed, with a relative large flow rate, although ascending airflow in which warm air ascends in an indoor environment for heating in the winter is formed, it is possible to rapidly increase the temperature of the indoor space in the area defined from the floor surface to the height of an adult as the user activity area.

In addition, the air discharged by the upper discharge vanes 81*a* and 83*a* and the lower discharge vanes 81*b* and

83*b* form swirling airflow by a wind speed, density, a temperature difference, thereby facilitating mixing of indoor air. Therefore, the indoor temperature can rapidly increase in the heating operation.

In addition, the upper discharge vanes 81*a* and 83*a* and the lower discharge vanes 81*b* and 83*b* may extend to form a curved surface toward the air discharge direction.

The discharge vanes 81, 82, 83 and 84 include a first discharge vane 81, a second discharge vane 82, a third discharge vane 83 and a fourth discharge vane 84 capable of opening and closing the outlets 22 formed along the four sides of the panel 20.

Each of the first to fourth discharge vanes 80 includes the upper discharge vanes 81*a* and 83*a* and the lower discharge vanes 81*b* and 83*b*. That is, each of the first to fourth discharge vanes 80 includes dual guide portions.

Specifically, referring to FIG. 2, the first discharge vane 81 includes the upper discharge vane 81*a* and the lower discharge vane 81*b*. The third discharge vane 83 includes the upper discharge vane 83*a* and the lower discharge vane 83*b*.

Although not shown in FIG. 2, each of the second discharge vane 82 and the fourth discharge vane 84 includes the upper discharge vane and the lower discharge vane.

The first discharge vane 81 and the third discharge vane 83 are positioned in directions opposite to each other. The second discharge vane 82 and the fourth discharge vane 84 are positioned in directions opposite to each other.

The first vane 81 and the third discharge vane 83 may be positioned perpendicular to the second discharge vane 82 and the fourth discharge vane 84.

In FIG. 1, the first discharge vane 81 is spaced apart from the third discharge vane 83 in a horizontal direction and the second discharge vane 82 is spaced apart from the fourth discharge vane 83 in a vertical direction. That is, the first discharge vane 81 and the third discharge vane 83 are provided to open and close the outlets 22 formed in the vertical direction and the second discharge vane 82 and the fourth discharge vane 84 are provided to open and close the outlets 22 formed in the horizontal direction.

Referring to FIG. 2, a virtual horizontal line parallel to the ground forming a horizontal surface or a ceiling surface, on which the panel 20 is mounted, and passing through the rotation center of the third discharge vane 83 and the rotation center of the first discharge vane 81 is defined as a horizontal reference line h.

Based on the horizontal reference line h, the rotation angle of the upper discharge vane or the lower discharge vane may be determined.

In addition, virtual straight lines drawn along the width direction of the discharge vane 80, that is, the longitudinal section of the discharge vane 80, are defined as extension lines L1 and S1.

The extension lines include the upper extension line S1 which is the virtual straight line drawn along the longitudinal sections of the upper discharge vanes 81*a* and 83*a* and the lower extension line L1 which is the virtual straight line drawn along the longitudinal sections of the lower discharge vanes 81*b* and 83*b*.

Accordingly, an angle a between the horizontal reference line h and the upper extension line 81 may be understood as the rotation angles of the upper discharge vanes 81*a* and 83*a*, and an angle b between the horizontal reference line h and the lower extension line L1 may be understood as the rotation angles of the upper discharge vanes 81*b* and 83*b*.

This is applicable to the second discharge vane 82 and the fourth discharge vane 84 which are not shown in FIG. 2. That is, the description of the horizontal reference line h and the extension lines S1 and L1 is applicable to the second vane group 82 and the fourth discharge vane 84 which are vertically disposed. Accordingly, the rotation angle of the upper discharge vanes of the second discharge vane 82 and the fourth discharge vane 84 may be defined as the first rotation angle a and the rotation angle of the lower discharge vanes of the second vane groups 82 and 84 may be defined as the second rotation angle b.

The angle between the horizontal reference line h and extension lines S1 of the upper discharge vanes 81*a* and 83*a* is referred to as a first rotation angle a and the angle between the horizontal reference line h and the extension lines L1 of the lower discharge vanes 81*b* and 83*b* is referred to as a second rotation angle b.

Meanwhile, in the first discharge vane 81 to the fourth discharge vane 84, angles a between the horizontal reference line h and the extension lines S1 of the upper discharge vanes 81*a* and 83*a* may be different. Similarly, in the first discharge vane 81 to the fourth discharge vane 84, angles b between the horizontal reference line h and the extension lines L1 of the upper discharge vanes 81*b* and 83*b* may be different. This will be described below.

The rotation range of the upper discharge vanes 81*a* and 83*a* may be less than that of the lower discharge vanes 81*b* and 83*b*.

That is, the range of the first rotation angle a may be less than that of the second rotation angle b. For example, the range of the first rotation angle a may be set to 58° to 74°, and the range of the second rotation angle b may be set to 15° to 74°.

The discharge motor 90 may be connected to the discharge vanes 81, 82, 83 and 84 to provide power. In addition, the discharge motor 90 may rotate the discharge vane 80 and the outlets 22 may be opened and closed by rotation of the discharge vane 80. For example, a plurality of discharge motors 90 may be provided to be connected to the discharge vanes 81, 82, 83 and 84.

In addition, the discharge motor 90 may include a step motor.

A suction grill 30 is mounted at the center of the panel 20. The suction grill 30 forms the lower appearance of the air conditioner 10 and has a substantially rectangular frame shape. The suction grill 30 includes a grill body 32 having a grid shape and including an inlet 34. A filter member 36 for filtering air sucked through the inlet 34 is provided on the grill body 32. For example, the filter member 36 may have a substantially rectangular frame shape.

The outlets 22 may be disposed outside the suction grill 30 in four directions. For example, the outlets 22 may be provided outside the inlet 34 in the up, down, left and right directions. By disposing the inlet 34 and the outlets 22, air of the indoor space is sucked into and conditioned in the casing 50 by the central portion of the panel 20, and the conditioned air may be discharged through the outlets 22 to the outside of the panel 20 in four directions.

Cover mounting portions 27 are formed at four corners of the panel body 21. The cover mounting portions 27 may be formed by perforating at least a portion of the panel body 21. The cover mounting portions 27 are used to check the services of the plurality of parts mounted on the rear surface of the panel 20 or operation of the air conditioner 10 and may be configured to be opened or closed by the cover member 40.

Air flow in the air conditioner 10 will be briefly described. When the fan motor 65 is driven to generate rotation force in the fan 60, air of the indoor space is sucked through the inlet 34 and is filtered by the filter member 36. The sucked air flows to the fan 60 through the inner space of the air guide 68 and the flow direction of air is changed through the fan 60.

Air sucked through the inlet 34 flows upward, flows into the fan 60, and flows to the outside through the fan 60. Air passing through the fan 60 is heat-exchanged through the heat exchanger 70 and the heat-exchanged air flows downward, thereby being discharged through the outlets 22.

That is, air is sucked through the suction grill 30 located at the center of the panel 20 and is discharged through the outlets 34 after flowing from the casing 50 toward the outside of the suction grill 30.

As described above, the upper discharge vanes 81*a* and 83*a* and the lower discharge vanes 81*b* and 83*b* are linked by a plurality of links to rotate. Therefore, the upper discharge vanes 81*a* and 83*a* and the lower discharge vanes 81*b* and 83*b* rotate by one discharge motor 90.

Hereinafter, the connection and rotation structure of the upper discharge vanes 81*a* and 83*a* and the lower discharge vanes 81*b* and 83*b* will be described in detail.

Figure 3:
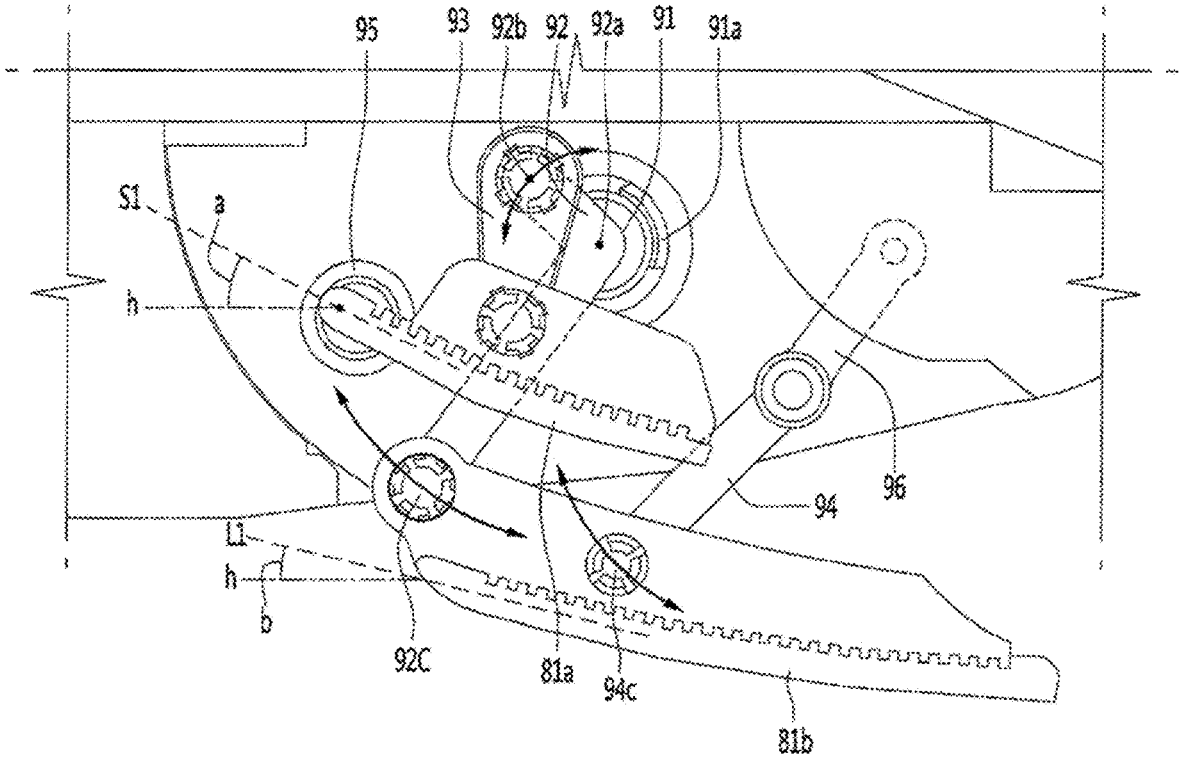
FIG. 3 is a partial enlarged view of "A" of FIG. 2.

FIG. 3 is a partial enlarged view of "A" of FIG. 2. FIG. 3 shows the connection state and rotation operation of the upper discharge vane 81*a* and the lower discharge vane 81*b* based on the first discharge vane 81.

Since the first discharge vane 81 to the fourth discharge vane 84 are different from each other in arrangement or formation position but are equal to each other in the configuration, for the upper discharge vanes and the lower discharge vanes of the second discharge vane 82, the third discharge vane 83 and the fourth discharge vane 84, refer to the description of the upper discharge vane 81*a* and the lower discharge vane 81*b* of the first discharge vane 81.

Referring to FIG. 3, the air conditioner 10 further includes a motor connector 91 coupled with the discharge motor 90, a rotation link 92 connected with the discharge motor 90 coupled to the motor connector 91 and capable of rotating, and a slave link 93 coupled to one end of the rotation link 92 to guide rotation of the upper discharge vane 81*a*.

The motor connector 91 may be provided inside the panel 20. For example, the motor connector 91 may be located on the inner surface of the panel body 21 in which the outlet 22 is formed.

The motor connector 91 may be coupled with the discharge motor 90 at one side thereof. The rotation shaft of the discharge motor 90 may extend in the direction of the outlet 22 through the motor connector 91.

The rotation shaft of the discharge motor 90 may be coupled to the rotation center 92*a* of the rotation link 92. Accordingly, the rotation link 92 may rotate about the rotation center 92*a* according to rotation of the discharge motor 90.

The motor connector 91 includes a stop projection 91*c* for restricting rotation of the rotation link 92. The stop projection 91*c* may be formed to protrude in the direction of the outlet 22 along a portion of the circumference of the motor connector 91.

The stop projection 91*c* may restrict rotation of the rotation link 92 when the lower discharge vane 81*b* reaches a position where the outlet 22 is closed, such that the lower discharge vane 81*b* no longer rotates.

The rotation link 92 may be coupled to the rotation shaft of the discharge motor 90 at the rotation center 92*a*. Accordingly, the rotation link 92 may rotate clockwise or counterclockwise with respect to the rotation center 92*a* by rotation of the discharge motor 90.

A first rotation shaft 92*b* coupled with the slave link 93 is formed on one end of the rotation link 92, and a second rotation shaft 92*c* coupled with the lower discharge vane 81*b* is formed on the other end of the rotation link 92.

The second rotation shaft 92*c* rotates according to rotation of the discharge motor 90 (see an arrow), and thus the lower discharge vane 81*b* receives force and rotates in the upward-and-downward direction to open and close the outlet 22.

The second rotation shaft 92*c* is coupled to one end of the lower discharge vane 81*b*. At this time, the second rotation shaft 92*c* is coupled with an upstream end for guiding discharged air.

In addition, the lower discharge vane 81*b* may be connected to the panel 20 by a second fixing shaft 96. The second fixing shaft 96 may be formed at one side of the panel 20 to extend toward the outlet 22.

In addition, a guide link 94 rotatably coupled to the second fixing shaft 96 may be connected to the center of the lower discharge vane 81*b* to guide upward and downward rotation of the lower discharge vane 81*b*.

That is, the guide link 94 may be coupled to the lower discharge vane 81*b* at the downstream side of the second rotation shaft 92*c* in the air discharge direction.

Therefore, the lower discharge vane 81*b* may rotate to open and close the outlet 22 according to rotation of the rotation link 92. At this time, the second rotation angle b of the lower discharge vane 81*b* may be determined according to the rotation degree of the rotation link 92, that is, the rotation angle of the discharge motor 90.

Similarly, the first rotation shaft 92*b* rotates according to rotation of the discharge motor 90 (see an arrow) and thus the slave link 93 coupled to the first rotation shaft 92*b* rotates, thereby guiding rotation of the upper discharge vane 81*a*. For example, when the first rotation shaft 92*b* rotates counterclockwise, the slave link 93 may move according to rotation of the first rotation shaft 92*b* such that the upper discharge vane 81*a* rotates upward or downward.

A hole for coupling of the first rotation shaft 92*b* is formed in one side of the slave link 93 and a protrusion for coupling to the upper discharge vane 81*b* is formed on the other side of the slave link 93.

The upper discharge vane 81*a* is coupled to be fixed to the panel 20 by the first fixing shaft 95 and the first fixing shaft 95 becomes the rotation center of the upper discharge vane 81*a*. Accordingly, the upper discharge vane 81*a* may rotate about the first fixing shaft 95 in the upward-and-downward direction by force received from the slave link 93.

That is, the upper discharge vane 81*a* may rotate according to rotation of the rotation link 92. At this time, the first rotation angle a of the upper discharge vane 81*b* may be determined according to the rotation degree of the rotation link 92, that is, the rotation angle of the discharge motor 90.

Since the width of the upper discharge vane 81*a* located inside the outlet 22 is less than that of the lower discharge vane 81*b*, the upper discharge vane 81*a* needs to minimize flow resistance against the discharged air and to secure the rotation angle. Accordingly, the upper discharge vane 81*a* is not directly coupled to the rotation link 92 but is connected to the rotation link 92 through the slave link 93.

Similarly, the rotation link 92 may be formed such that a distance r1 from the rotation center 92*a* to the first rotation shaft 92*b* is less than a distance r2 from the rotation center 91*c* to the second rotation shaft 92*c*.

That is, the rotation link 92 may be formed such that a length from the rotation center 92*c* to the slave link 93 is greater than a length from the rotation center 92*c* to the lower discharge vanes 81*b* and 83*b*.

For example, the rotation link 92 may extend in two directions to form a predetermined angle from the rotation center 92*a*. That is, the rotation link 92 may be formed as a frame having a "¬" shape or a "ﺑ" shape. At this time, the rotation center 91*c* may be located at the center of the bending portion of the rotation link 92.

The distance r1 from the rotation center 91*c* to the first rotation shaft 92*b* of the slave link 83 and the distance r2 from the rotation center 91*c* to the second rotation shaft 92*c* may be understood as rotation radii.

As a result, the first rotation angle a may be less than the second rotation angle b by rotation of the rotation link 92, as described above.

That is, when the discharge motor 90 rotates by a predetermined angle, the second rotation angle b may be changed to be greater than the first rotation angle a. For example, when the discharge motor 90 rotates by 10°, the first rotation angle a may be 4.7° and the second rotation angle b may be 20.5°.

Figure 4:
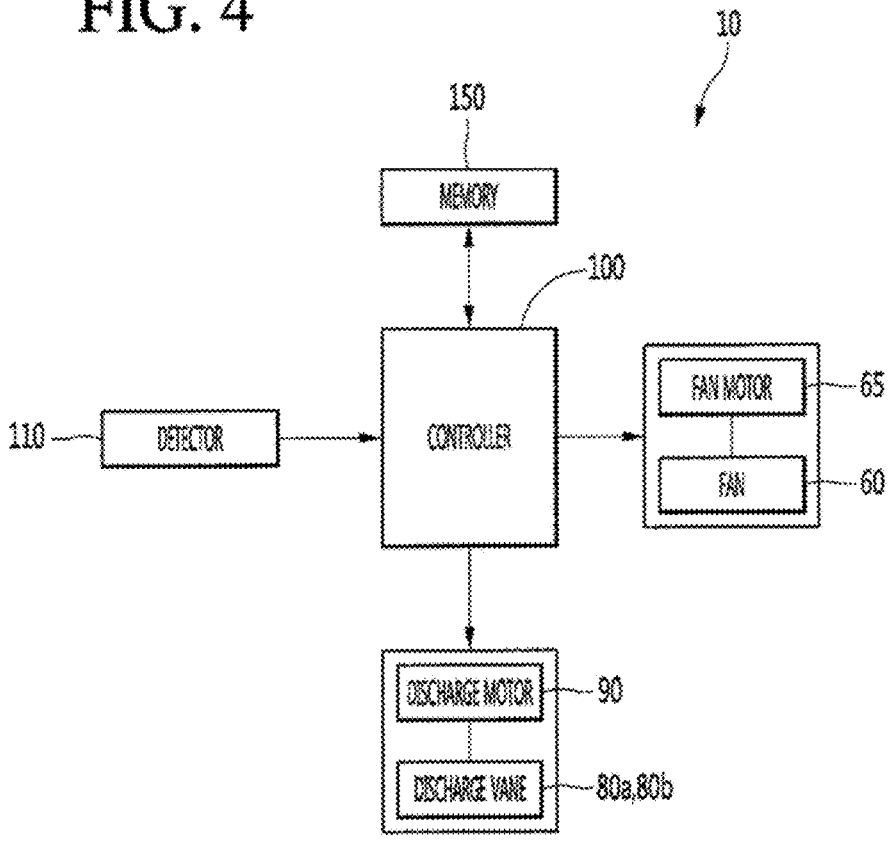
FIG. 4 is a block diagram showing the configuration of a ceiling type air conditioner according to an embodiment of the present invention.

FIG. 4 is a block diagram showing the configuration of a ceiling type air conditioner according to an embodiment of the present invention.

Referring to FIG. 4, the air conditioner 10 further includes a controller 100 for controlling the fan motor 65 and the discharge motor 90.

The controller 100 may control the fan motor 65 in order to control an air volume or a wind speed. Accordingly, the controller 100 may control rotation of the fan 60 connected to the fan motor 65.

In addition, the controller 100 may control rotation of the discharge motor 90. For example, the controller 100 may control rotation of the discharge vane 80, that is, the upper discharge vane and the lower discharge vane, by controlling the rotation angle or the rotation direction of the discharge motor 90.

In addition, the controller 100 may control the discharge motor 90 connected to the discharge vanes 81, 82, 83 and 84 respectively provided in the outlets 22 corresponding to the four sides of the panel 20.

That is, the controller 100 may individually control the rotation angles of the first to fourth discharge vanes 81, 82, 83 and 84.

As described above, the upper discharge vane and the lower discharge vane provided in any one of the discharge vanes 81, 82, 83 and 84 may be linked to each other to rotate by rotation of one discharge motor 90. Accordingly, the ranges of the first rotation angle and the second rotation angle b may be determined according to the rotation angle of the discharge motor 90.

In Table 1 below, the ranges of the first rotation angle a and the second rotation angle b determined according to the rotation angle range of the discharge motor 90 (the step motor) are defined as a first angle group P1, a second angle group P2, a third angle group P3 and a fourth angle group P4.

Specifically, the first to fourth angle groups may be defined as the ranges of the first rotation angle a of the upper discharge vane and the second rotation angle b of the lower discharge vane according to the rotation angle of the discharge motor 90 connected to the discharge vanes 81, 82, 83 and 84.

TABLE 1

| | First angle group (P1) | Second angle group (P2) | Third angle group (P3) | Fourth angle group (P4) |
|---|---|---|---|---|
| Rotation angle of the discharge motor 90 | 80°~103° | 92°~106° | 100°~109° | 103°~113° |
| First rotation angle (a) | 58°~71° | 64°~72° | 68°~73° | 71°~74° |
| Second rotation angle (b) | 15°~45° | 25°~55° | 35°~64° | 45°~72° |

The first angle group P1 to the fourth angle group P4 may be defined as ranges having different minimum and maximum angles.

The first rotation angle a of the first angle group P1 is defined as a range of 58° or more and less than 71° and the second rotation angle b thereof is defined as a range of 15° or more and less than 45°.

The first rotation angle a of the second angle group P2 is defined as a range of 64° or more and less than 72° and the second rotation angle b thereof is defined as a range of 25° or more and less than 55°.

The first rotation angle a of the third angle group P3 is defined as a range of 68° or more and less than 73° and the second rotation angle b thereof is defined as a range of 35° or more and less than 64°.

The first rotation angle a of the fourth angle group P4 is defined as a range of 71° or more and less than 74° and the second rotation angle b thereof is defined as a range of 45° or more and less than 72°.

The controller 100 may perform control such that the first discharge vane 81 to the fourth discharge vane 84 rotate in any one of the first to fourth angle groups P1, P2, P3 and P4.

For example, the controller 100 may control the first rotation angle a and second rotation angle b of the first discharge vane 81 to follow the first angle group P1. At the same time, the controller 100 may control the first angle a and second rotation angle b of the second discharge vane 82 to follow the second angle group P2.

In this case, the upper discharge vane and the lower discharge vane provided in each of the discharge vanes 81, 82, 83 and 84 may rotate between a minimum rotation angle and a maximum rotation angle corresponding to any one angle group.

For example, the upper discharge vane 81*a* of the first discharge vane 81 may continuously rotate between the minimum rotation angle of 58° and the maximum rotation angle of 71° corresponding to the first angle group P1, and the lower discharge vane 81*b* thereof may continuously rotate between the minimum rotation angle of 15° and the maximum rotation angle of 45°.

The first angle group P1 may have the smallest first rotation angle a and second rotation angle b among the first angle group P1 to the fourth angle group P4.

Accordingly, the discharge vane rotating along the first angle group P1 may guide discharged air in a relatively horizontal direction as compared to the discharge vane rotating in the other angle groups P2, P3 and P4. Accordingly, it is possible to form discharge airflow closest to the indoor ceiling surface.

In addition, the fourth angle group P4 may have largest first rotation angle a and second rotation angle b among the first angle group P1 to the fourth angle group P4.

Accordingly, the discharge vane rotating along the fourth angle group P4 may guide discharged air in a relatively vertical direction as compared to the discharge vane rotating in the other angle groups P1, P2 and P3. Accordingly, it is possible to form discharge airflow closest to the indoor floor surface.

When the discharge vanes 81, 82, 83 and 84 are controlled to be changed from the first angle group P1 to the fourth angle group P4, discharged air may be guided to form horizontal airflow flowing relatively close to the ceiling surface and then guided to form vertical airflow flowing relatively close to the floor surface.

Meanwhile, the air conditioner 10 further includes a detector 110 capable of detecting a time, a distance, a temperature of an indoor space, and presence/absence of an occupant.

The detector 110 may include a timer for detecting an operation time, a distance detection sensor provided on the front surface of the panel 20 and a temperature detection sensor for detecting an indoor temperature.

The temperature detection sensor may detect and transmit the indoor temperature to the controller 100. Accordingly, the controller 100 may determine whether to reach a target temperature set by the user based on the result of detection.

The air conditioner 10 further includes a memory for storing necessary data.

The memory 150 may store predetermined information for operation of the air conditioner. In addition, the controller 100 may transmit and receive data to and from the memory 150. Accordingly, the controller 100 may read and written data from and in the memory 150.

Meanwhile, a natural wind mode of the operation modes of the air conditioner may be defined as an operation mode for enabling the air conditioner for providing cooling or heating simulates the frequency characteristics of airflow formed by natural wind to provide a pleasant feeling capable of being obtained by natural wind to the user in the indoor space.

Figure 6A:
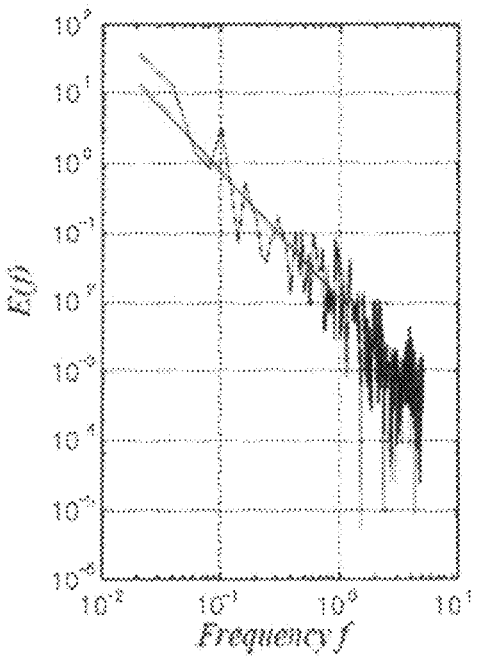
FIG. 6 is an airflow frequency characteristic graph showing characteristics of natural wind and airflow frequency characteristic graph in a natural wind mode (whirlwind) according to an embodiment of the present invention.

Here, the airflow frequency characteristics of natural wind have high energy distribution in a low frequency region and low energy distribution in a high frequency distribution (see FIG. 6A).

The natural wind mode of a conventional air conditioner is implemented while changing air volume with time based on an auto swing mode in which rotation angles of all vanes are changed from a minimum angle to a maximum angle.

In this case, since airflow discharged in the natural wind mode of the conventional air conditioner has low energy distribution in the low frequency region, it is difficult to simulate natural wind.

The conventional air conditioner for solving such a problem performs control to reduce air volume or to change the rotation angular speed of the discharge vane. However, in this method, since the guide direction of the discharged air is not formed based on the user, it takes a considerable time to achieve an air conditioning environment set by the user. Therefore, it is difficult to provide a pleasant feeling satisfied by the user.

However, the ceiling type air conditioner 10 according to the embodiment of the present invention can maximally simulate the frequency characteristics of natural wind and rapidly improve the pleasant feeling of the user, by forming whirlwind in the natural wind mode.

Hereinafter, a control method for generating whirlwind will be described in detail with reference to FIG. 5.

Figure 5:
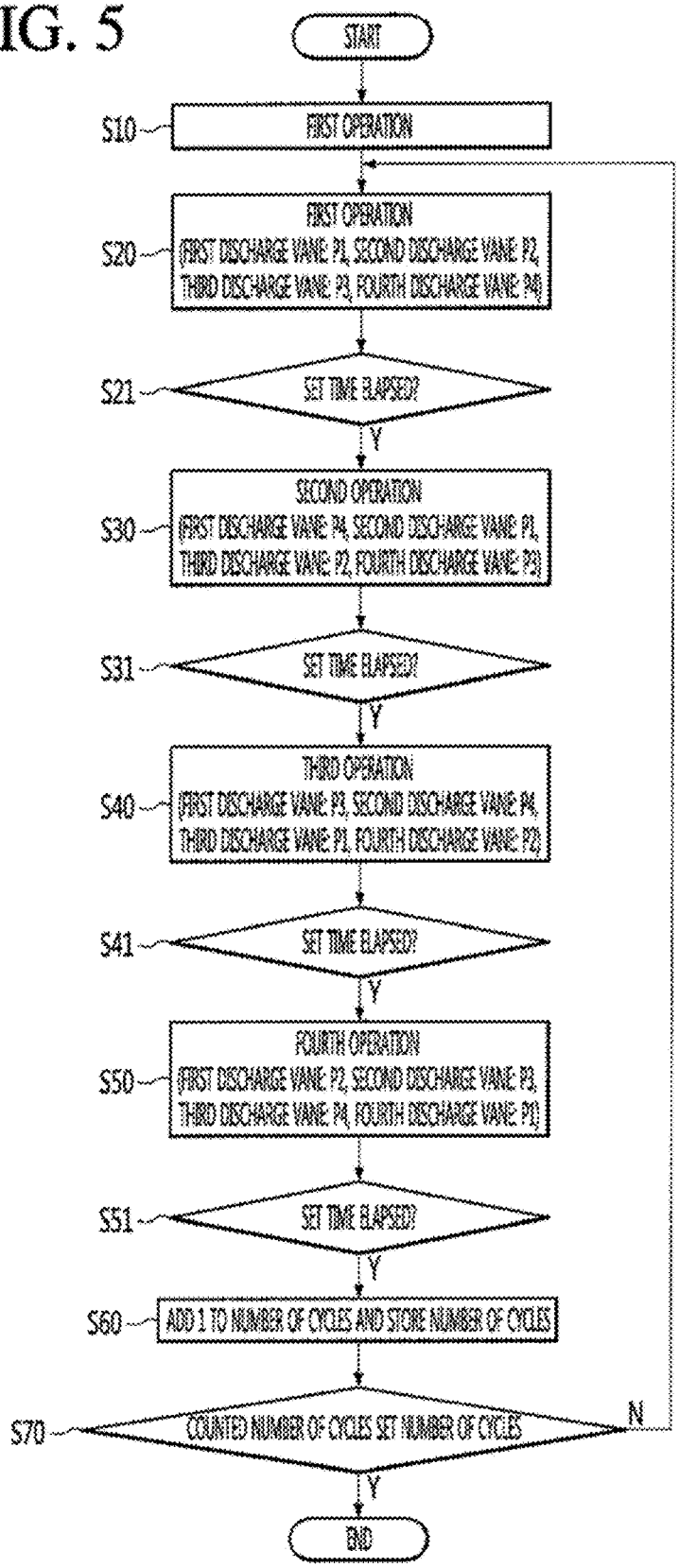
FIG. 5 is a flowchart illustrating a method of controlling a ceiling type air conditioner according to an embodiment of the present invention.

FIG. 5 is a flowchart illustrating a method of controlling a ceiling type air conditioner according to an embodiment of the present invention.

Referring to FIG. 5, the ceiling type air conditioner according to the embodiment of the present invention may enter a natural wind mode when cooling operation or heating operation is provided (S10).

Specifically, the controller 100 may receive a signal of the operation unit (not shown) and control the components such as the detector 110, the fan motor 65 and the discharge motor 90 to perform operation set in the natural wind mode.

Meanwhile, in an indoor environment requiring heating or cooling, the user may input the natural wind mode as the mode of the ceiling type air conditioner 10 through the operation unit (not shown). At this time, the air conditioner provides relatively warm air in an indoor environment requiring heating and provide relatively cold air in an indoor environment requiring cooling.

When the natural wind mode is input, the controller 100 may perform control such that the first discharge vane 81, the second discharge vane 82, the third discharge vane 83 and the fourth discharge vane 84 rotate in different angle groups P1, P2, P3 and P4. At this time, since the first to fourth discharge vanes 81, 82, 83 and 84 guide air while rotating in ranges set in different angle groups, the directions of airflows formed by air discharged in four ways are different.

First, the controller 100 may perform control such that the first to fourth discharge vanes 81, 82, 83 and 84 perform first operation (S20).

Specifically, the first operation is defined as operation in which the first discharge vane 81 rotates in the first angle group P1, the second discharge vane 82 rotates in the second angle group P2, the third discharge vane 83 rotates in the third angle group P3, and the fourth discharge vane 84 rotates in the fourth angle group P4.

Specifically, in the first operation, airflow formed by air discharged through the first discharge vane 81 is formed in an upper horizontal direction relatively close to the ceiling surface, airflow formed by air discharged through the second discharge vane 82 is formed at a position lower than that of airflow formed by the first discharge vane 81, airflow formed by air discharged through the third discharge vane 83 is formed at a position lower than that of airflow formed by the second discharge vane 82, and airflow formed by air discharged through the fourth discharge vane 84 is formed at a position lower than that of airflow formed by the third discharge vane 83 to form airflow in a lower vertical direction closest to the floor surface of the indoor space.

The controller 100 may determine whether an execution time of the first operation has elapsed a set time (S21).

The controller 100 may detect the execution time of the first operation by the detector 110. The set time may be set to 60 seconds, for example.

In addition, upon determining that the execution time of the first operation has elapsed the set time, the controller 100 may perform control such that the first to fourth discharge vanes 81, 82, 83 and 84 perform second operation (S30).

Specifically, the second operation is defined as operation in which the first discharge vane 81 rotates in the fourth angle group P4, the second discharge vane 82 rotates in the first angle group P1, the third discharge vane 83 rotates in the second angle group P2, and the fourth discharge vane 84 rotates in the third angle group P3.

Specifically, in the second operation, airflow formed by air discharged through the second discharge vane 82 is formed in an upper horizontal direction relatively close to the ceiling surface, airflow formed by air discharged through the third discharge vane 83 is formed at a position lower than that of airflow formed by the second discharge vane 82, airflow formed by air discharged through the fourth discharge vane 84 is formed at a position lower than that of airflow formed by the third discharge vane 83, airflow formed by air discharged through the first discharge vane 81 is formed at a position lower than that of airflow formed by the fourth discharge vane 84 to form airflow in a lower vertical direction closet to the floor surface of the indoor surface.

As a result, in the second operation, the discharge vane for forming airflow at a relatively low position is changed from the first operation clockwise (or counterclockwise).

Accordingly, airflows formed by air discharged in respective directions are downwardly formed clockwise (or counterclockwise) to cause a flow pressure difference and a temperature difference and airflow mixing may be caused due to the flow pressure difference and the temperature difference.

The controller 100 may determine whether the execution time of the second operation has elapsed a set time (S31), similarly to the first operation.

In addition, upon determining that the execution time of the second operation has elapsed the set time, the controller 100 may perform control such that the first to fourth discharge vanes 81, 82, 83 and 84 perform third operation (S40).

Specifically, the third operation is defined as operation in which the first discharge vane 81 rotates in the third angle group P3, the second discharge vane 82 rotates in the fourth angle group P4, the third discharge vane 83 rotates in the first angle group P1, and the fourth discharge vane 84 rotates in the second angle rotation P2.

Specifically, in the third operation, airflow formed by air discharged through the third discharge vane 83 is formed an upper horizontal direction relatively close to the ceiling surface, airflow formed by air discharged through the fourth discharge vane 84 is formed at a position lower than that of airflow formed by the third discharge vane 83, airflow formed by air discharged through the first discharge vane 81 is formed at a position lower than that of airflow formed by the fourth discharge vane 84, and airflow formed by air discharged through the second discharge vane 82 is formed at a position lower than that of airflow formed by the first discharge vane 81 to form airflow in a lower vertical direction closest to the floor surface of the indoor space.

As a result, in the third operation, the discharge vane for forming relatively low airflow is changed from the second operation clockwise (or counterclockwise).

Accordingly, airflows formed by air discharged in respective directions are downwardly formed clockwise (or counterclockwise) to cause a flow pressure difference and a temperature difference and airflow mixing may be caused due to the flow pressure difference and the temperature difference.

The controller 100 may determine whether the execution time of the third operation has elapsed a set time (S41).

In addition, upon determining that the execution time of the third operation has elapsed the set time, the controller 100 may perform control such that the first to fourth discharge vanes 81, 82, 83 and 84 perform fourth operation (S50).

Specifically, the fourth operation is defined as operation in which the first discharge vane 81 rotates in the second angle rotation P2, the second discharge vane 82 rotates in the third angle group P3, the third discharge vane 83 rotates in the fourth angle group P4, and the fourth discharge vane 84 rotates in the first angle group P1.

Specifically, in the fourth operation, airflow formed by air discharged through the fourth discharge vane 84 is formed in an upper horizontal direction relatively close to the ceiling surface, airflow formed by air discharged through the first discharge vane 81 is formed at a position lower than that of airflow formed by the fourth discharge vane 84, airflow formed by air discharged through the second discharge vane 82 is formed at a position lower than that of airflow formed by the first discharge vane 81, airflow formed by air discharged through the third discharge vane 83 is formed at a position lower than that of airflow formed by the second discharge vane 82 to form airflow in a lower vertical direction closest to the floor surface of the indoor space.

As a result, in the fourth operation, the discharge vane for forming relatively low airflow is changed from the third operation clockwise (or counterclockwise).

Accordingly, airflows formed by air discharged in respective directions are downwardly formed clockwise (or counterclockwise) to cause a flow pressure difference and a temperature difference and airflow mixing may be caused due to the flow pressure difference and the temperature difference.

The controller 100 may determine whether the execution time of the fourth operation has elapsed a set time (S51).

In addition, upon determining that the execution time of the four operation has elapsed the set time, the controller 100 may determine that one operation cycle is completed. At this time, the controller 100 may count and store the number of cycles in the memory 150 (S60).

In other words, one operation cycle may be understood as sequential rotation of the first discharge vane 81 in the first angle group P1 to the fourth angle group P4.

For example, when a first operation cycle is completed, the controller 100 may change the counted number of cycles from 0 to +1 and store the counted number of cycles in the memory 150.

In addition, the controller 100 may compare the currently counted number of cycles with a set number of counts. Specifically, the controller 100 may determine whether the currently counted number of cycles is greater or less than the set number of cycles (S70).

Here, the set number of cycles may vary according to the temperature set by the user. For example, if a difference between the indoor temperature and the temperature set by the user is large, the set number of cycles may be proportionally increased.

The controller 100 may detect the indoor temperature using the detector 110, calculate a difference between the indoor temperature and the temperature set by the user and determine the set number of cycles according to a table stored in the memory 150.

At this time, when the currently counted number of cycles is less than the set number of cycles, the method may return to the first operation S20 to repeat the above-described operation.

Upon determining that the currently counted number of cycles is equal to or greater than the set number of cycles, the controller 100 may determine that whirlwind is formed to achieve the air conditioning environment set by the user and end the natural wind mode.

When the natural wind mode ends, the counted number of cycles may be reset.

Since the first to fourth discharge vanes 81, 82, 83 and 84 for performing the first operation to the fourth operation guide air in different angle groups in each operation, the directions of airflow discharged in four ways differ between operation.

In addition, as the first operation to the fourth operation are performed for a predetermined time, airflows formed through the discharge vanes 81, 82, 83 and 84 collide and mix with each other due to pressure, temperature or structure. As the operations are sequentially performed, the direction of the airflow may be continuously and sequentially changed and thus the temperature distribution and flow pressure difference of the indoor air may be rapidly changed. Accordingly, mixing between airflows formed by the discharge vanes in the indoor space may be facilitated. Therefore, it is possible to rapidly reach the air conditioning environment set by the user.

In addition, as the first operation to the fourth operation are sequentially performed, the discharge vane for forming the horizontal airflow flowing close to the ceiling surface and the discharge vane for forming the vertical airflow flowing close to the floor surface are sequentially changed.

As a result, airflows formed by the discharge vanes 81, 82, 83 and 84 may continuously change the flow pressure difference and the temperature difference in the indoor space as the time has elapsed and thus airflow formed in the indoor space may have characteristics similar to that of natural wind (see FIG. 8B).

In particular, as the first operation to the fourth operation progress, since the directions of the airflows generated in four ways are changed to the downward or upward direction clockwise or counterclockwise, mixing of airflows in the indoor space may be similar to flow mixing of whirlwind by the flow pressure difference (see the temperature distributions of FIGS. 7 and 8).

For example, airflow formed by air discharged from the first discharge vane 81 is changed from horizontal airflow to vertical airflow in a stepwise manner for a predetermined time from the first operation to the fourth operation, and airflows formed by air discharged in other directions may be changed to different positions in a stepwise manner such that mixing of airflows are slowly performed clockwise or counterclockwise in the indoor space.

Accordingly, even if the user is not brought into contact with relatively warm or cold wind, the user may feel a natural and mild pleasant feeling by airflow having characteristics similar to that of natural wind.

Here, indoor airflow generated by the first operation to the fourth operation is defined as whirlwind. The whirlwind may be generated by performing one cycle including the first operation to the fourth operation predetermined times.

FIG. 6 is a graph showing comparison between the characteristics of natural wind and the frequency characteristics of a natural wind mode (whirlwind) according to the embodiment of the present invention.

Specifically, FIG. 6A is an airflow frequency characteristic graph showing the characteristics of natural wind and FIG. 8B is an airflow frequency characteristic graph in a natural wind mode (whirlwind) according to the embodiment of the present invention.

Referring to FIG. 6A, in the airflow frequency characteristic graph of natural wind, a horizontal axis denotes a frequency f and a vertical axis denotes energy E according to the frequency. The horizontal axis and the vertical axis are represented by a logarithmic scale.

Natural wind has high energy in a low frequency region and has low energy in a high frequency region. This means that natural wind has a high energy distribution in the low frequency region and a low energy distribution in the high frequency region.

The energy pattern of natural wind represented in the form of a straight line has a slope of 1/f.

Figure 6B:
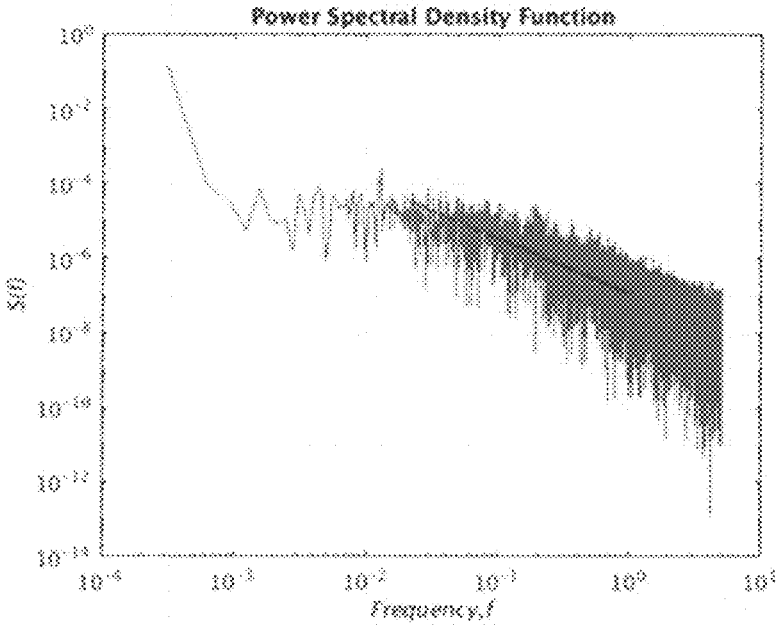

Referring to FIG. 6B, it can be seen that whirlwind generated when the ceiling type air conditioner 10 according to the embodiment performs the natural wind mode has characteristics similar to those of natural wind.

Specifically, the air conditioner 10 generates wind having high energy in a low frequency region, having low energy in a high frequency region and having the slope of 1/f. Accordingly, it is possible to provide the user with a pleasant feeling which is lighter and more changeable, by providing wind relatively similar to natural wind in the natural wind mode.

FIG. 7 is a table showing a result of comparison between a natural mode (whirlwind) in cooling operation of a ceiling type air conditioner according to an embodiment of the present invention and a general auto swing mode, and FIG. 8 is a table showing a result of comparison between a natural mode (whirlwind) in heating operation of a ceiling type air conditioner according to an embodiment of the present invention and a general auto swing mode.

Referring to FIG. 7, the airflow distributions of the general auto swing mode and the natural wind mode in the cooling operation of the air conditioner 10 according to the embodiment of the present invention may be confirmed. Here, as the experimental condition, when the outdoor temperature is 35° C., an initial indoor temperature is 33° C., and the fan rotation speed is 600 (RPM), the set temperature of the air conditioner is set to 26° C.

The vertical temperature distribution in the natural wind mode according to the embodiment of the present invention is more uniform than the vertical temperature distribution in the general auto swing mode.

In addition, as the experimental result, in the natural wind mode according to the embodiment of the present invention, it takes 11 minutes to decrease the indoor temperature by 1° C. and takes 20 minutes and 51 seconds to reach the set temperature.

In contrast, in the auto swing mode, it takes 10 minutes and 45 seconds to decrease the indoor temperature by 1° C. and takes 22 minutes and 40 seconds to reach the set temperature. It can be seen that a difference between the result of the natural wind mode and the result of the auto swing mode is small.

In the natural wind mode according to the embodiment of the present invention, it is possible to solve a problem that it takes a considerable time for the indoor air conditioning environment to reach an environment set by a user in the natural wind mode of the conventional air conditioner.

That is, since the air conditioner 10 according to the embodiment of the present invention can relatively shorten a time required for the indoor temperature to reach a temperature set by a user, it is possible to rapidly provide a pleasant feeling to the user.

Referring to FIG. 8, airflow distributions in the auto swing mode and the natural wind mode when heating is performed in a relatively low indoor environment (temperature) condition may be confirmed.

In the indoor environment in which heating is performed, although warm air is discharged downward, warm air ascends by ascending airflow such that the temperature of the user activity area may slowly increase.

Referring to the vertical temperature distribution, in the natural wind mode according to the embodiment of the present invention, whirlwind is formed and relatively centralized heating (airflow temperature distribution) is provided as compared to the auto swing mode.

In addition, as the experimental condition, when the outdoor temperature is 7° C., an initial indoor temperature is 12° C., and the fan rotation speed is 670 (RPM), if the set temperature of the air conditioner is set to 26° C., it takes 06 minutes and 46 seconds to increase the indoor temperature by 1° C. and takes 28 minutes and 08 seconds to reach the set temperature in the auto swing mode of the air conditioner 10 according to the embodiment of the present invention. In the natural wind mode, it takes 06 minutes and 50 seconds to increase the indoor temperature by 1° C. and takes 29 minutes and 40 seconds to reach the set temperature.

That is, even in the natural wind mode, the time required to increase the temperature and the time required to reach the set temperature similar to those of the general auto swing mode can be obtained.

Therefore, according to the natural wind mode of the air conditioner 10 according to the embodiment of the present invention, since a time required to reach the air conditioning environment set by the user is relatively shortened, it is possible to provide more rapidly provide a pleasant feeling.

In addition, it can be seen that the vertical temperature difference (1.1 m to 0.1 m) in the natural wind mode is less than the vertical temperature difference in the auto swing mode, by formation of whirlwind. Specifically, it can be seen that the vertical temperature difference value is 2.3 (° C.) in the auto swing mode and is 1 (° C.) in the natural wind mode. Therefore, it is possible to prevent a local unpleasant feeling of the user due to a draft phenomenon.

The invention claimed is:

1. A method of controlling a ceiling type air conditioner including a panel located on a ceiling surface, and outlets formed to correspond to four sides of the panel, and first to fourth discharge vane sets that open and close the outlets, each of the first to fourth discharge vane sets including an upper discharge vane, and a lower discharge vane located below the upper discharge vane and rotating along with the upper discharge vane, the method comprising:

performing a first operation in which the first discharge vane set rotates within a first angle group, the second discharge vane set rotates within a second angle group, the third discharge vane set rotates within a third angle group, and the fourth discharge vane set rotates within a fourth angle group;

performing a second operation in which the first discharge vane set rotates within the fourth angle group, the second discharge vane set rotates within the first angle group, the third discharge vane set rotates within the second angle group, and the fourth discharge vane set rotates within the third angle group;

performing a third operation in which the first discharge vane set rotates within the third angle group, the second discharge vane set rotates within the fourth angle group, the third discharge vane set rotates within the first angle group, and the fourth discharge vane set rotates in the second angle group; and performing a fourth operation in which the first discharge vane set rotates within the second angle group, the second discharge vane set rotates within the third angle group, the third discharge vane set rotates within the fourth angle group, and the fourth discharge vane set rotates within the first angle group, wherein rotation angles of the first to the fourth angle groups have different ranges.

2. The method of claim 1, wherein the first to fourth discharge vane sets:

guide discharged air closest to the ceiling surface when rotating within the first angle group, and guide discharged air closest to an indoor floor surface when rotating within the fourth angle group.

3. The method of claim 1, wherein the first to fourth operations are performed for a set time.

4. The method of claim 1, wherein the first angle group includes a smallest rotation angle of the upper discharge vane and a smallest rotation angle of the lower discharge vane.

5. The method of claim 4, wherein the fourth angle group includes a largest rotation angle of the upper discharge vane and a largest rotation angle of the lower discharge vane.

6. The method of claim 1, wherein a range of a rotation angle of the upper discharge vane is less than a range of a rotation angle of the lower discharge vane.

7. The method of claim 1, wherein, in the first angle group, a rotation angle of the upper discharge vane is set to 58° or more and less than 71°, and a rotation angle of the lower discharge vane is set to 15° or more and less than 45°.

8. The method of claim 7, wherein, in the second angle group, a rotation angle of the upper discharge vane is set to 64° or more and less than 72°, and a rotation angle of the lower discharge vane is set to 25° or more and less than 55°.

9. The method of claim 8, wherein, in the third angle group, a rotation angle of the upper discharge vane is set to 68° or more and less than 73°, and a rotation angle of the lower discharge vane is set to 35° or more and less than 64°.

10. The method of claim 9, wherein, in the fourth angle group, a rotation angle of the upper discharge vane is set to 71° or more and less than 74°, and a rotation angle of the lower discharge vane is set to 45° or more and less than 72°.

11. A ceiling type air conditioner, comprising:

a panel located on a ceiling surface;

outlets formed to correspond to four sides of the panel;

first to fourth discharge vane sets located at the outlets, respectively, and each including an upper discharge vane, and a lower discharge vane located below the upper discharge vane and rotating along with the upper discharge vane; and a controller configured to control rotation angles of the first to fourth discharge vane sets, wherein the controller:

controls the first discharge vane set such that the first discharge vane set is rotated within a first angle group including a smallest rotation angle;

controls the second discharge vane set such that the second discharge vane set is rotated within a second angle group having a rotation angle greater than that of the first angle group;

controls the third discharge vane set such that the third discharge vane set is rotated within a third angle group having a rotation angle greater than that of the second angle group; and controls the fourth discharge vane set such that the fourth discharge vane set is rotated within a fourth angle group having a rotation angle greater than that of the third angle group.

12. The ceiling type air conditioner of claim 11, wherein the controller controls the second to third discharge vane sets to sequentially follow the first angle group when a predetermined time has elapsed.

13. The ceiling type air conditioner of claim 11, wherein the controller controls the first discharge vane set to sequentially rotate within the second to fourth angle groups when a predetermined time period has elapsed.

14. The ceiling type air conditioner of claim 13, wherein the controller counts a number of cycles in which the first discharge vane set rotates within the first to fourth angle groups.

15. The ceiling type air conditioner of claim 14, wherein the controller repeatedly controls the first discharge vane set to rotate within the first angle group when the counted number of cycles is less than a predetermined number of cycles.

* * * * *